US007544072B2

(12) United States Patent
Rubenstein et al.

(10) Patent No.: US 7,544,072 B2
(45) Date of Patent: Jun. 9, 2009

(54) RETRACTABLE PROTECTION APPARATUS FOR ELECTRONIC DEVICE PINS

(75) Inventors: Brandon Rubenstein, Loveland, CO (US); Roger Nattkemper, Antelope, CA (US); Eric Daniel, Sacramento, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/926,274

(22) Filed: Oct. 29, 2007

(65) Prior Publication Data

US 2009/0111293 A1 Apr. 30, 2009

(51) Int. Cl.
*H01R 13/64* (2006.01)

(52) U.S. Cl. ..... 439/135; 439/381

(58) Field of Classification Search ..... 439/135, 439/381

See application file for complete search history.

(56) References Cited

U.S. PATENT DOCUMENTS 4,173,387 A 11/1979 Zell
4,197,945 A 4/1980 Sherwood
4,428,640 A 1/1984 Pittman
4,614,385 A 9/1986 Gendernalik
4,822,550 A 4/1989 Komathu
4,879,630 A 11/1989 Boucard et al.
4,935,581 A 6/1990 Komathu
5,232,091 A 8/1993 Hennessy et al.
5,342,206 A * 8/1994 Grabbe et al. ..... 439/71
5,348,488 A * 9/1994 Green et al. ..... 439/140
5,373,626 A 12/1994 Youngfleish
5,507,653 A * 4/1996 Stoner ..... 439/74
6,171,133 B1 * 1/2001 Altuner et al. ..... 439/381
6,203,356 B1 * 3/2001 Thomsen ..... 439/381
6,572,412 B2 * 6/2003 Beuther et al. ..... 439/620.21
6,866,552 B2 3/2005 Koehler
2003/0027445 A1 2/2003 Carney et al.
2004/0166705 A1 8/2004 Koehler

* cited by examiner

*Primary Examiner*—Gary F. Paumen

(57) ABSTRACT

An apparatus for protecting an array of pins of an electronic device is provided. The apparatus includes a pin protector defining an array of holes therethrough, wherein each hole is configured to receive one of the pins. The apparatus also comprises a spring element configured to bias the pin protector away from the electronic device toward an end of each of the pins. The spring element is also configured to allow the pin protector to be retracted toward the electronic device to expose the pins for insertion into a socket or similar component.

19 Claims, 14 Drawing Sheets

RETRACTABLE PROTECTION APPARATUS FOR ELECTRONIC DEVICE PINS

BACKGROUND

Many electronic devices or components employ a significant number of electrically conductive pins by which the devices are to be connected to a circuit. Due to the increasing number of pins employed in various electronic devices, such pins typically are rather small and delicate, thus being subject to bending or breaking under relatively light forces. One popular arrangement of such pins is a pin grid array (PGA), in which the pins extend from the bottom of the device and are arranged in a two-dimensional array. One particular example of a device employing a pin grid array is a processor board, which typically includes a computer processor integrated circuit (IC) mounted upon a small printed circuit board (PCB). The processor board may also include other peripheral components electronically connected to the processor. The processor board often includes an array of pins extending from the side of the board opposite the processor, allowing the processor board to be coupled to a motherboard by way of a socket, such as a zero-insertion-force (ZIF) socket.

To protect the pins both during delivery of the processor board and prior to installation of the processor board in a socket, a detachable plastic or metal cover may be attached to the processor board to cover the pins. In some cases, the cover is attached to a shroud surrounding the array of pins. Such a shroud is often designed to fit closely around the exterior of the socket to align the pins therewith, thus essentially guaranteeing a proper electrical connection between the processor board and the socket.

DETAILED DESCRIPTION

Generally, embodiments of the present invention provide an apparatus for protecting an array of pins of an electronic device. The electronic device may be, for example, an integrated circuit (IC) or a small printed circuit board (PCB) with a pin grid array on one side suitable for connection with a socket, although the electronic device is not limited to such a configuration. In one embodiment, the apparatus includes a pin protector defining an array of holes therethrough, wherein each hole is configured to receive one of the pins of the electronic device. Further included in the apparatus is a spring element configured to bias the pin protector away from the electronic device toward an end of each of the pins. The spring element is further configured to allow the pin protector to be retracted toward the electronic device to expose the pins for insertion into a socket or similar component.

In the various figures provided herein and discussed below, directional references, such as "upper," "lower," and the like, are utilized merely to provide a reference frame for facilitation of the description of the various apparatuses described below, and do not constitute a required or preferred orientation of the embodiments.

Figure 1A:
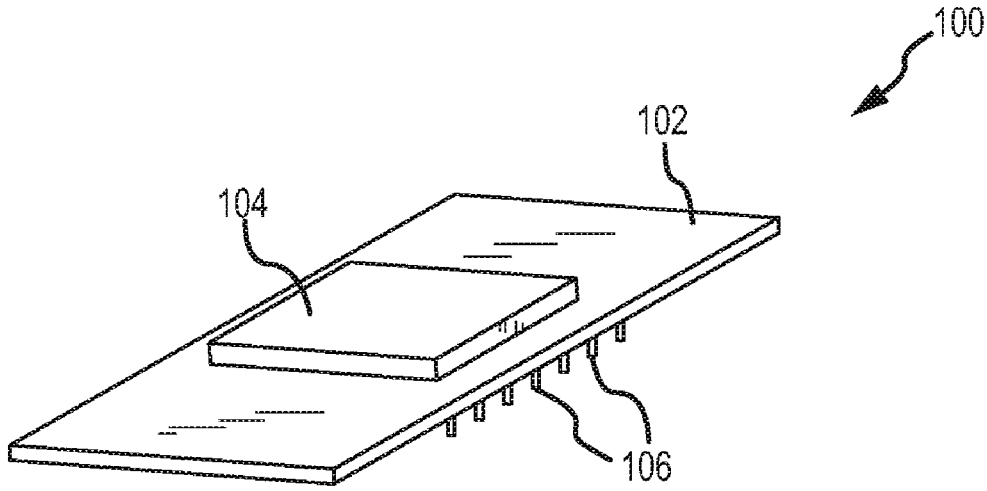
FIG. 1A is a perspective view of an upper side of a processor board employable with an embodiment of the invention.
Figure 1B:
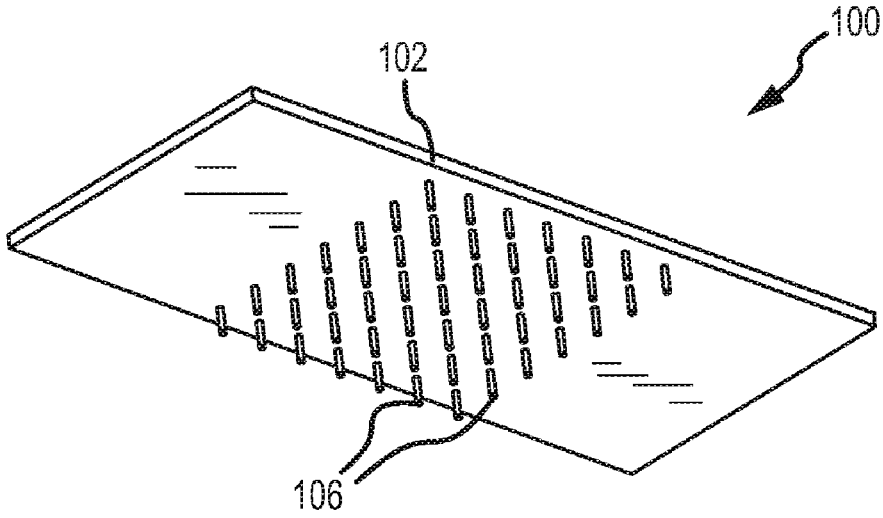
FIG. 1B is a perspective view of a lower side of the processor board of FIG. 1A.

FIGS. 1A and 1B provide a perspective view of the upper and lower side, respectively, of a processor board 100 to be employed as an example electronic device having connection pins to be protected. The processor board 100 includes a processor 104 packaged as a single IC soldered to the upper side of a printed circuit board (PCB) 102. Also included are pins 106 extending downward from the lower side of the PCB 102 to allow electrical connection between the processor board 100 and a socket described below. While the pins 106 of FIGS. 1A and 1B are arranged in identifiable rows and columns, other relative configurations of the pins 106 may be employed in other implementations.

Figure 2A:
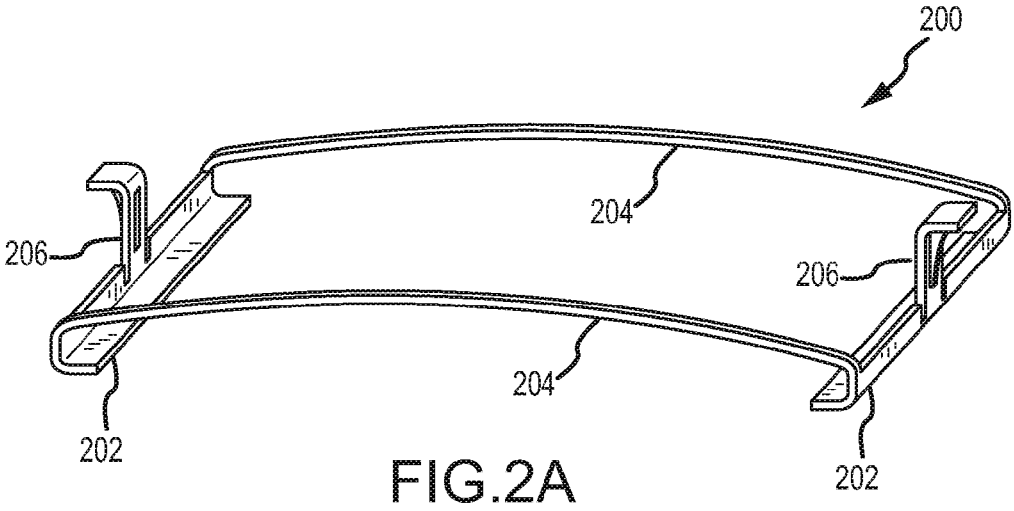
FIG. 2A is perspective view of a spring element of an apparatus according to an embodiment of the invention.
Figure 2B:
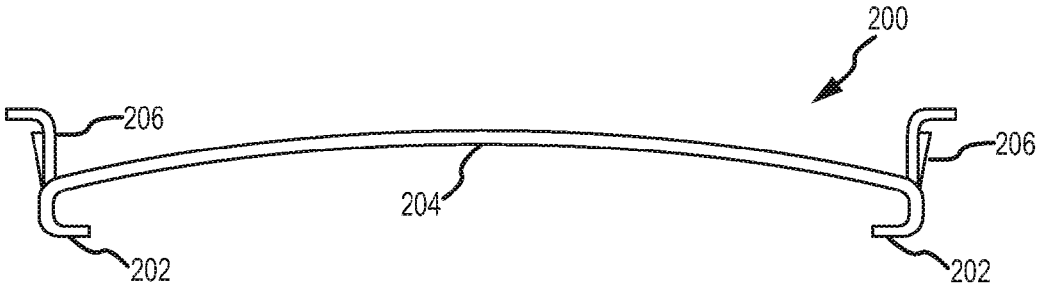
FIG. 2B is a side view of the spring element of FIG. 2A.
Figure 2C:
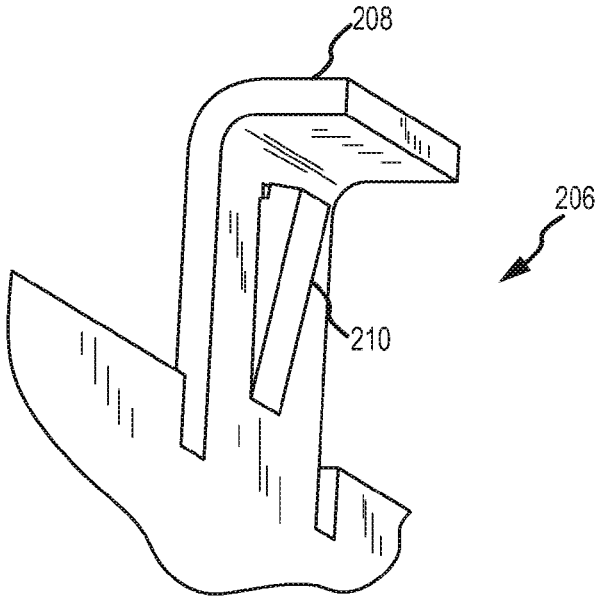
FIG. 2C is a close-up perspective view of a locking structure of the spring element of FIG. 2A.

An example of a portion of an apparatus for protecting the pins 106 of the processor board 100 is a spring element 200 depicted in the various views of FIGS. 2A, 2B, and 2C. The particular spring element 200 shown in FIGS. 2A-2C includes two hook structures 202, two springs 204, and two locking structures 206. The spring element 200 may be manufactured from a spring steel or a hardened stainless steel, either of which permit nonpermanent deformation of the spring element 200 during normal use. In other embodiments, a resilient plastic, foam, or other material capable of retaining its original shape, such as that shown in FIGS. 2A and 2B, may be utilized.

The hook structures 202 are configured to attach to opposing edges of the PCB 102 of the processor board 100. Typically, the hook structures 202 are of such size and shape to firmly grip the PCB 102 so that the spring element 200 does not slide along the edges of the PCB 102 while not damaging the PCB 102.

Each of the two springs 204 shown in FIGS. 2A and 2B are cantilever springs 204, with each end of one of the cantilever springs 204 being attached to a first end of each of the hook structures 202, while the other cantilever spring 204 is attached to a second end of each of the hook structures 202. Other implementations may employ different spring arrangements. For example, each cantilever spring 204 may instead be replaced by two opposing cantilevers, with each cantilever extending from a separate hook structure 202. In another implementation, one or more small coil springs coupled to the hook structures 202 may be utilized in lieu of, or in addition to, the cantilever springs 204. Many other spring arrangements may be employed in other embodiments. Further, a foam material may be used instead, the compression of which may act as a spring 204. Using the springs 204, the spring element 202 is configured to bias a pin protector (described in greater detail below) away from the processor board 100 toward the ends of the pins 106. The springs 204 also allow the pin protector be retracted toward the processor board 100 to expose the pins 106.

Coupled to each of the hook structures 202 is a locking structure 206, positioned substantially in the center of each hook structure 202 and extending upward. In the specific embodiment of FIGS. 2A-2C, the locking structure 206 includes a stop portion 208 and a lock portion 210, the function of which is described below in conjunction with the pin protector.

Figure 3A:
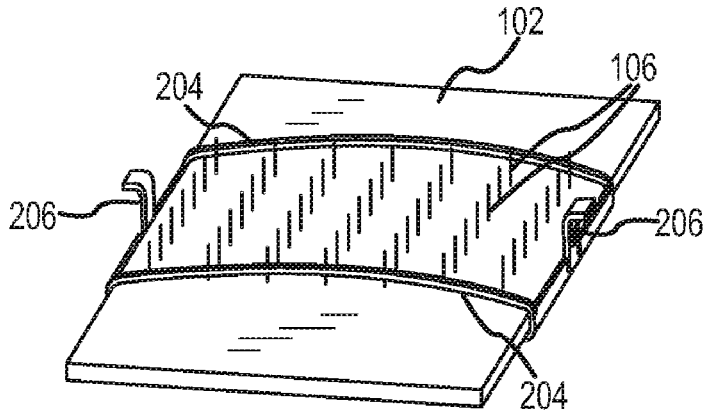
FIG. 3A is a perspective view of the lower side of an assembly including the processor board of FIG. 1A coupled with the spring element of FIG. 2A.
Figure 3B:
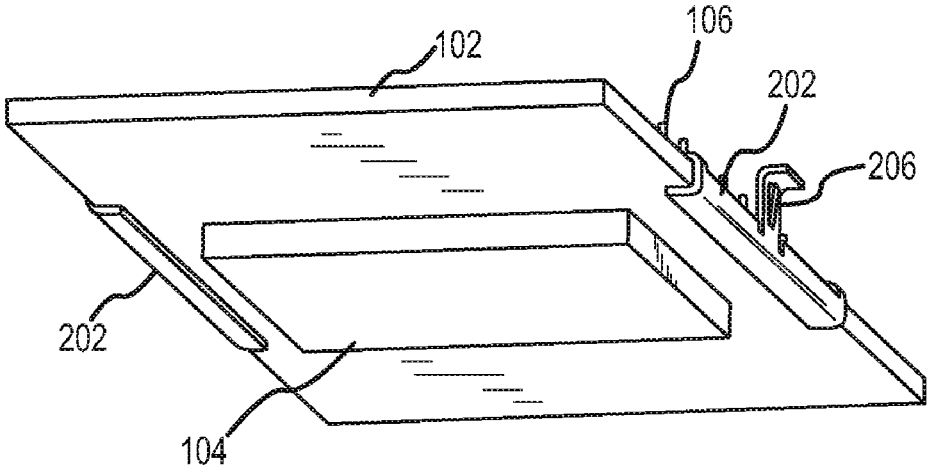
FIG. 3B is a perspective view of the upper side of the assembly of FIG. 3A.

FIGS. 3A and 3B depict lower and upper perspective views, respectively, of the spring element 200 as installed on the processor board 200. As seen in FIG. 3B, the hook structures 206 grip the edges of the PCB 102 at positions opposing the processor 104. The hook structures 206 are also of sufficient length to span the area occupied by the pins 106 on the bottom of the PCB 102, as seen in FIG. 3A. The cantilever springs 204 thus span the processor board 100 on either side of the array of pins 106, and remain flexed to provide a potential force away from the bottom of the processor board 100. In addition, the locking structures 206 extend in substantially the same direction from the bottom of the processor board 100 as do the pins 106. Other positions for the springs 204 and the hook structures 206 are also possible within the scope of the invention while providing the functionality described below.

Figure 4A:
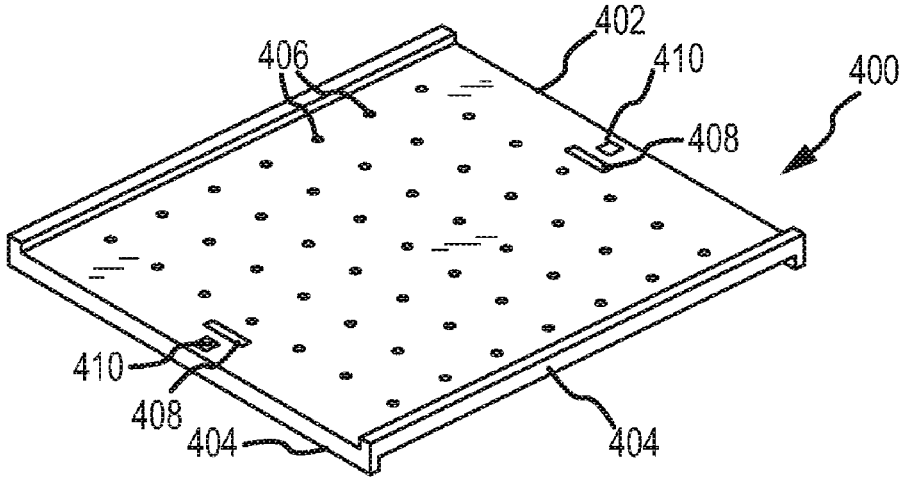
FIG. 4A is a perspective view of the lower side of a pin protector of an apparatus according to an embodiment of the invention.
Figure 4B:
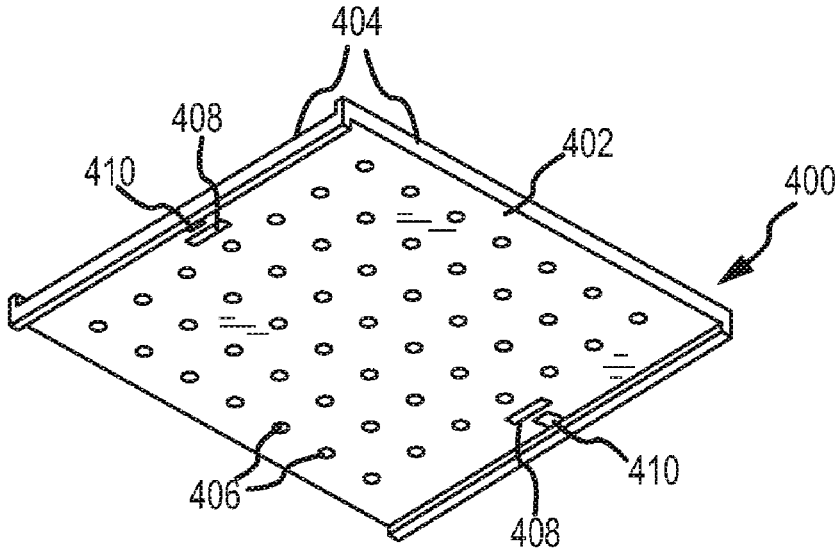
FIG. 4B is a perspective view of the upper side of the pin protector of FIG. 4A.
Figure 4C:
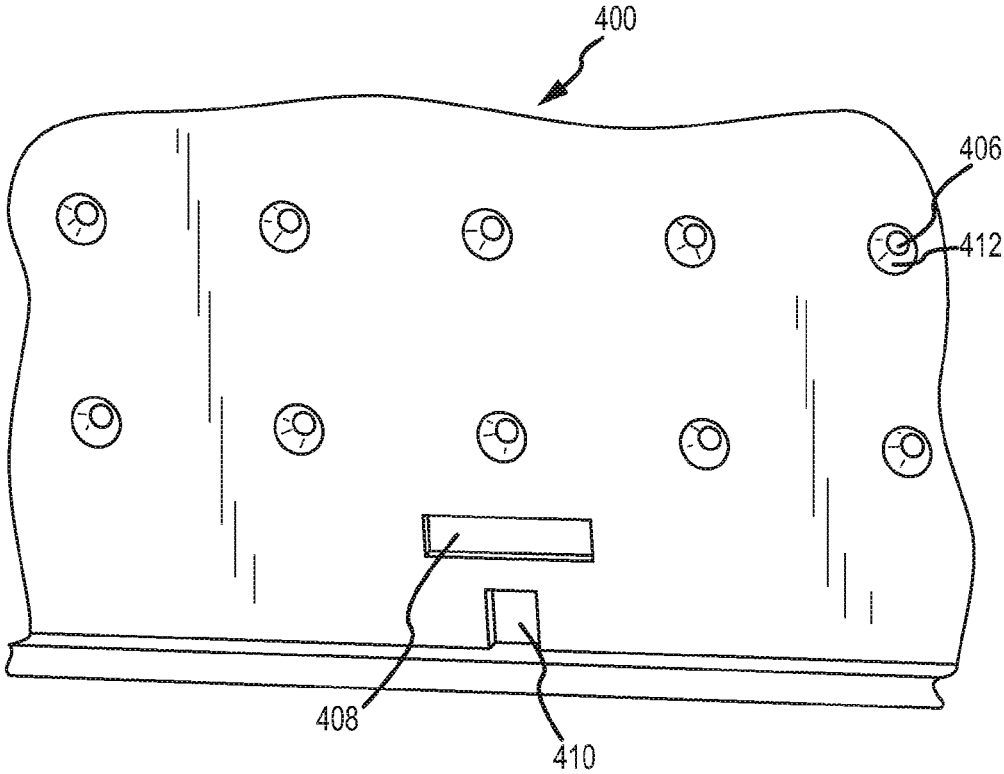
FIG. 4C is a close-up view of the upper side of the pin protector of FIG. 4A.

FIGS. 4A, 4B, and 4C provide varying views of an example of a pin protector 400 that may be used in conjunction with the spring element 200. The pin protector 400 forms a generally planar structure with a number of holes 406 formed therethrough. Each hole 406 corresponds with one of the pins 106 of the processor board 100 and configured so that each pin 106 may pass through its corresponding hole 406. In one implementation, each of the holes 406 may be countersunk to ease insertion of the pins 106 into the holes 406. The countersunk portion 412 of the holes 406 is shown in greater detail in FIG. 4C.

Also shown in FIGS. 4A-4C are first apertures 408, each taking the shape of a slot through which an associated locking structure 206 of the spring element 200 may extend. Further depicted in FIGS. 4A-4C are alignment apertures 410. The functionality of both the first apertures 408 and the alignment apertures 410 of the pin protector 400 is discussed in greater detail below.

In one embodiment, the pin protector 400 is manufactured from a nonconductive plastic material. However, other nonconductive materials, including those that exhibit a resistance to acquire electrostatic charge, may be employed to similar end. To promote sufficient stiffness of the pin protector 400, ribbed edges 404, as shown in FIGS. 4A and 4B, may be incorporated into the structure of the pin protector 400. Stiffening structures may be positioned elsewhere on the surface of the pin protector 400 in other implementations. For example, a shroud may be fashioned around the exterior edges of the pin protector 400 to further stiffen the pin protector 400.

Figure 5A:
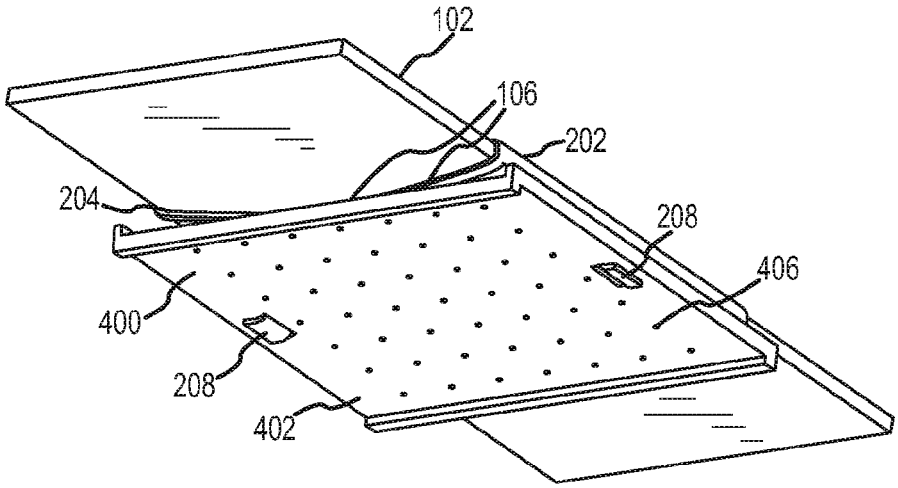
FIG. 5A is a perspective view of the lower side of an assembly including the processor board of FIG. 1A, the spring element of FIG. 2A, and the pin protector of FIG. 4A, with the pin protector in an extended position.
Figure 5B:
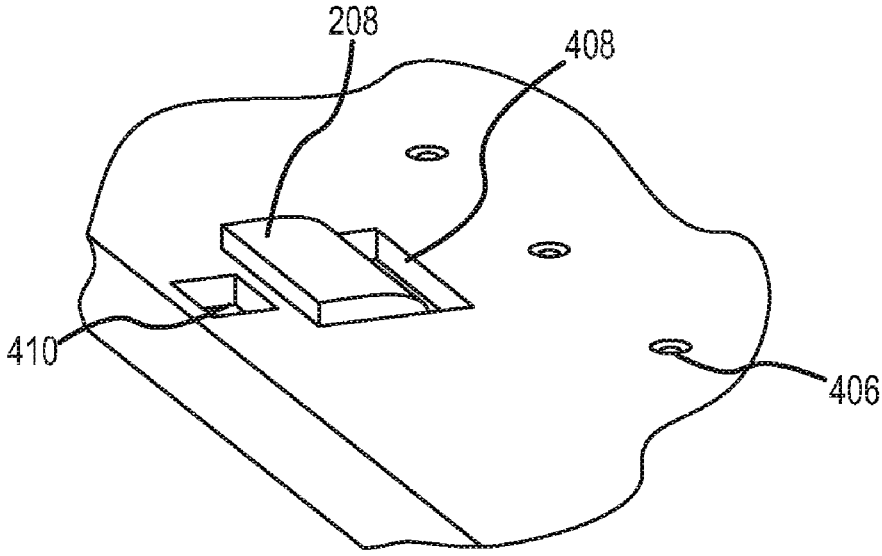
FIG. 5B is a close-up perspective view of the lower side of the assembly of FIG. 5A including the locking structure of the spring element.
Figure 5C:
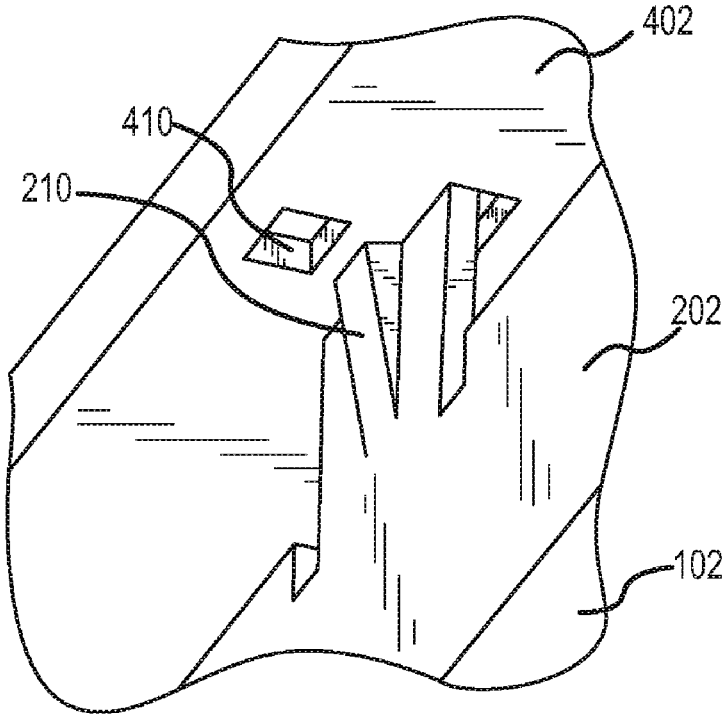
FIG. 5C is a close-up perspective view of the upper side of the assembly of FIG. 5A including the locking structure of the spring element.

FIGS. 5A-5C display various views of the pin protector 400 when attached to the processor board 100 by way of the spring element 200. More specifically, FIG. 5A provides a perspective view of the lower side of the processor board 100 with the pin protector 400 attached to the spring element 200 in an extended position. In this position, the pins 106 are inserted into the holes 406 of the pin protector 400, but do not extend beyond its lower surface, thus protecting the pins 106 from damage.

FIG. 5B provides a close-up perspective view of the lower side of the pin protector 400 and one of its first apertures 408 through which the stop portion 208 of one of the locking structures 206 extends. The cantilever springs 204 serve to bias the pin protector 400 against the stop portion 208 to prevent the springs 204 from urging the pin protector 400 past the ends of the pins 106.

FIG. 5C presents a close-up perspective view of the opposing side of the pin protector 400 from that shown in FIG. 5B. Shown therein is the position of the lock portion 210 of the locking structure 206, appearing as a tab making contact with the upper side of the pin protector 400, thus locking the pin protector 400 in the extended position between the stop portion 208 and the lock portion 210 of both locking structures 206. As a result, a force against the lower side of the pin protector 400 does not result in the pin protector 400 being relocated toward the bottom of the processor board 100.

Figure 6:
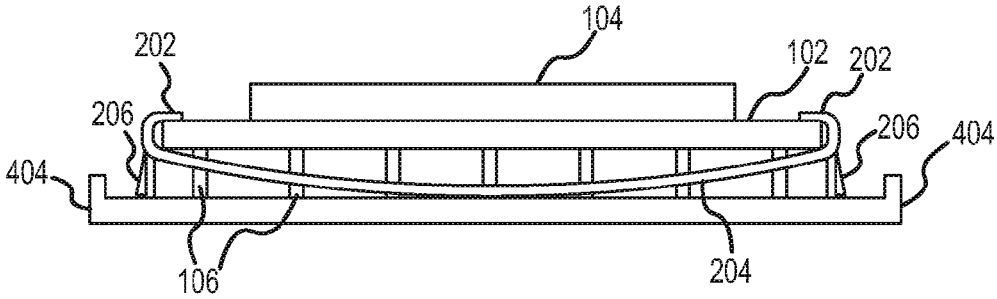
FIG. 6 is a side view of the assembly of FIG. 5A.

A side view of an entire assembly of the processor board 100, the spring element 200, and the pin protector 400, with the pin protector 400 in the extended position as described in FIGS. 5A-5C, is shown in FIG. 6. In this view, the spring elements 204 are shown maintaining a bias force downward against the pin protector 400. This force serves to automatically place the pin protector 400 in the extended position when the processor board 100 is removed from a socket or similar circuit component.

In one embodiment, the assembly of FIG. 6 may include a cover or shroud (not shown in FIG. 6) configured to substantially surround the external edges of the pin protector 400. The cover may be fashioned from metal, plastic, or other material capable of providing a barrier to external forces.

Such a cover may be coupled to either or both of the processor board 100 and the spring element 200 to protect the pin protector 400, and hence the pins 106 of the processor board 100, from inadvertent side impacts. In addition, if the cover closely surrounds the edges of the pin protector 400, the cover may prevent small foreign matter from entering the area between the pin protector 400 and the processor board 100, thus isolating the pins 106 from such matter.

Figure 7:
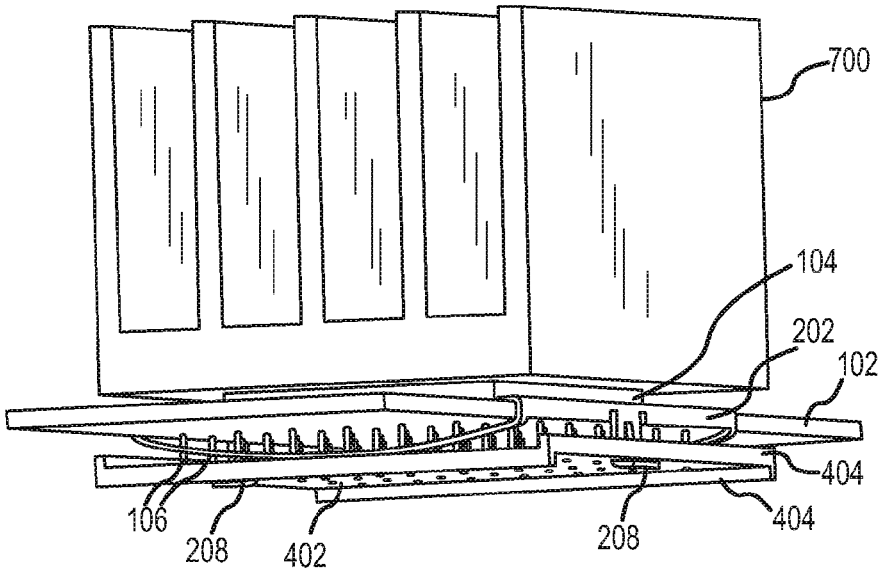
FIG. 7 is a lower perspective view of the assembly of FIG. 5A, further including a heat sink attached to the processor of the processor board.

FIG. 7 provides a perspective view of the assembly of FIG. 6 in the extended position, along with a heat sink 700 attached to the topside of the processor 104. Heat sinks are often placed in thermal communication with ICs that regularly generate a significant amount of heat in order to dissipate that heat. As shown in FIG. 7, the spring element 200 is sized and arranged such that it does not interfere with the placement of the heat sink 700 atop the processor 104.

Figure 8:
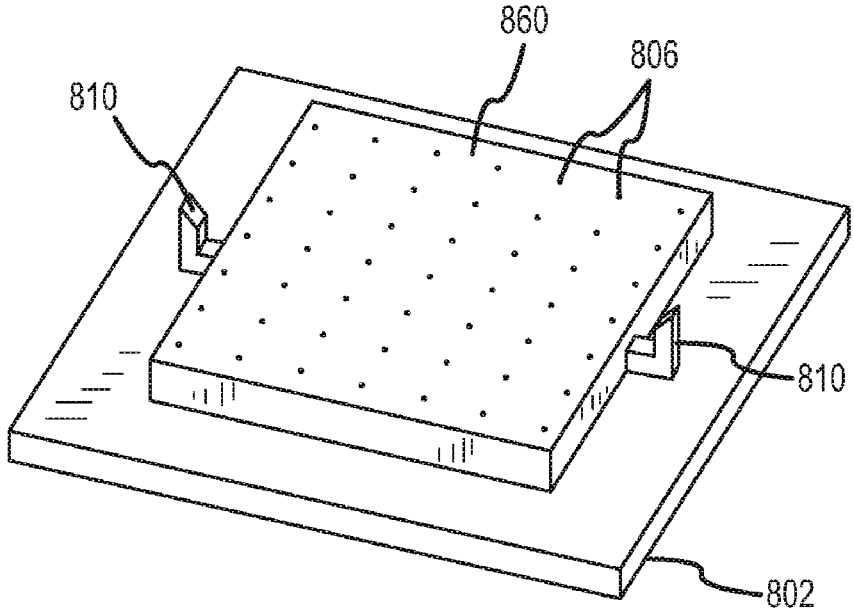
FIG. 8 is a perspective view of an upper side of a motherboard with a socket configured to accept the assembly of FIG. 5A.

FIG. 8 provides an upper perspective view of a socket 800 including a number of pin receiver holes 806, each of which is configured to receive one of the pins 106 of the processor board 100 in order to electrically couple the processor board 100 with a motherboard 802. Typically, the socket 800 is soldered to the top of the motherboard 802 by way of electrically conductive pads (not shown in FIG. 7) on the upper surface of the motherboard 802. Other constructs for connecting the socket 800 to the motherboard 802, such as by way of plated-through holes, may be employed in other implementations. The socket 800 of FIG. 8 also includes a pair of keys 810 extending out and up from the socket 800, with the top end of each key 810 being aligned with the alignment apertures 410 of the pin protector 400.

Figure 9A:
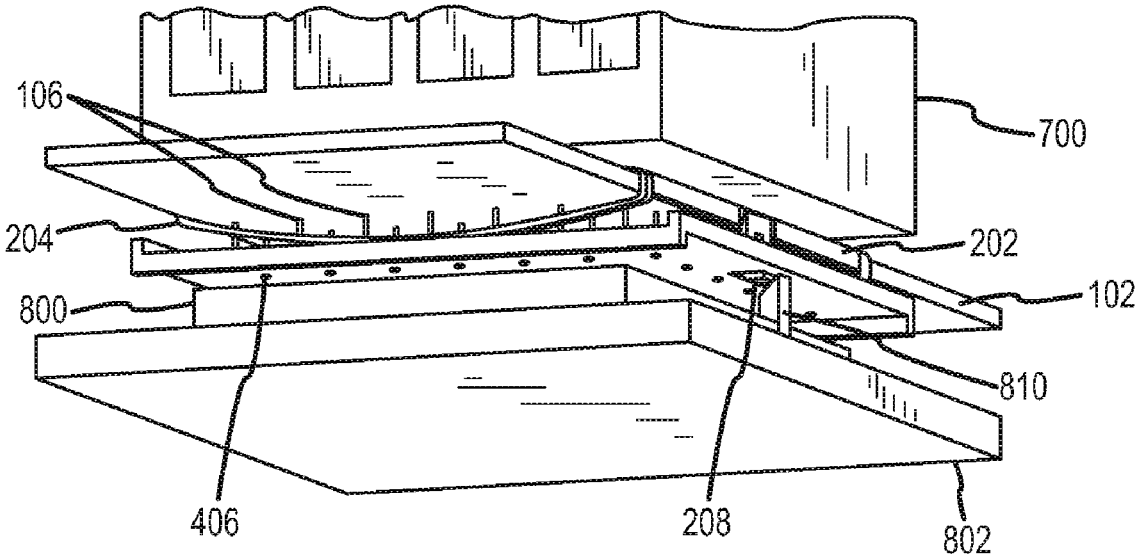
FIG. 9A is a perspective view of a lower side of the assembly of FIG. 5A and the motherboard of FIG. 8 with the pin protector in an extended position.
Figure 9B:
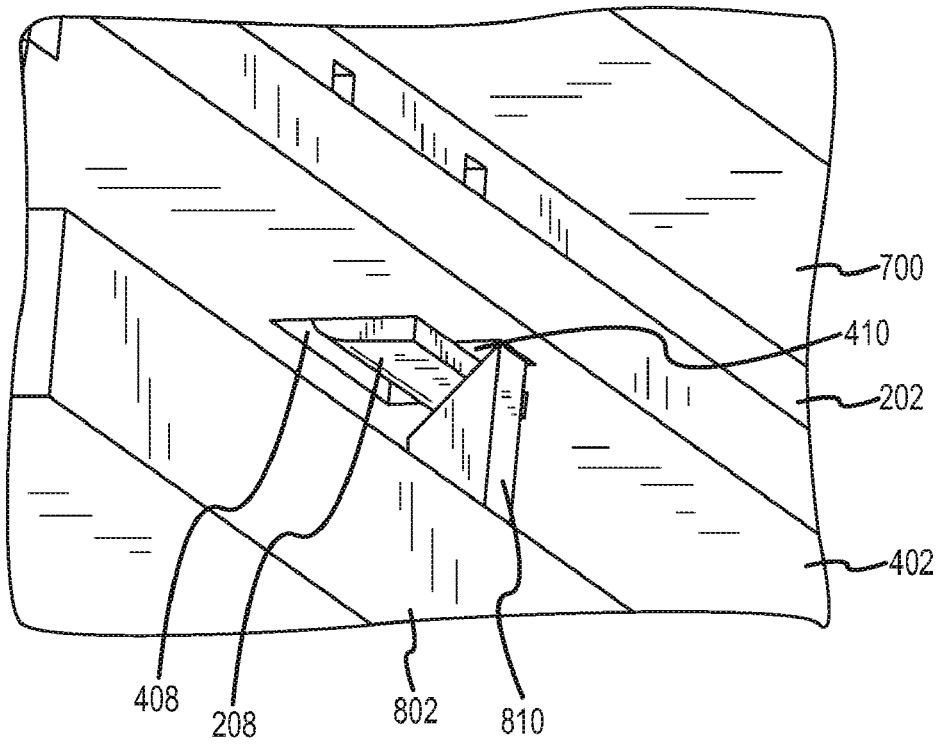
FIG. 9B is a close-up perspective view of the lower side of the assembly of FIG. 9A with the pin protector in an extended position.

FIGS. 9A and 9B provide different views of the assembly of FIG. 7 aligned for insertion into the socket 800. FIG. 9A, for example, provides a lower perspective view showing the assembly first making contact with the keys 810. FIG. 9B presents a close-up view of one of the keys 810 being aligned with its associated alignment aperture 410 to promote proper alignment of the pins 106 with the pin receiver holes 806 of the socket 800. In addition, the key 810 shown is making initial contact with the stop portion 208 of the one of the locking structures 206 as the assembly is placed atop the socket 800. Other means of aligning the pins 106 and the socket 800, such as dedicated alignment pins and matching alignment holes in any of the socket 800, the processor board 100, the spring element 200, and the pin protector 400, in lieu of or in addition to the keys 810 and the alignment apertures 410, may be employed to ensure proper alignment of the assembly with the socket 800.

Figure 10A:
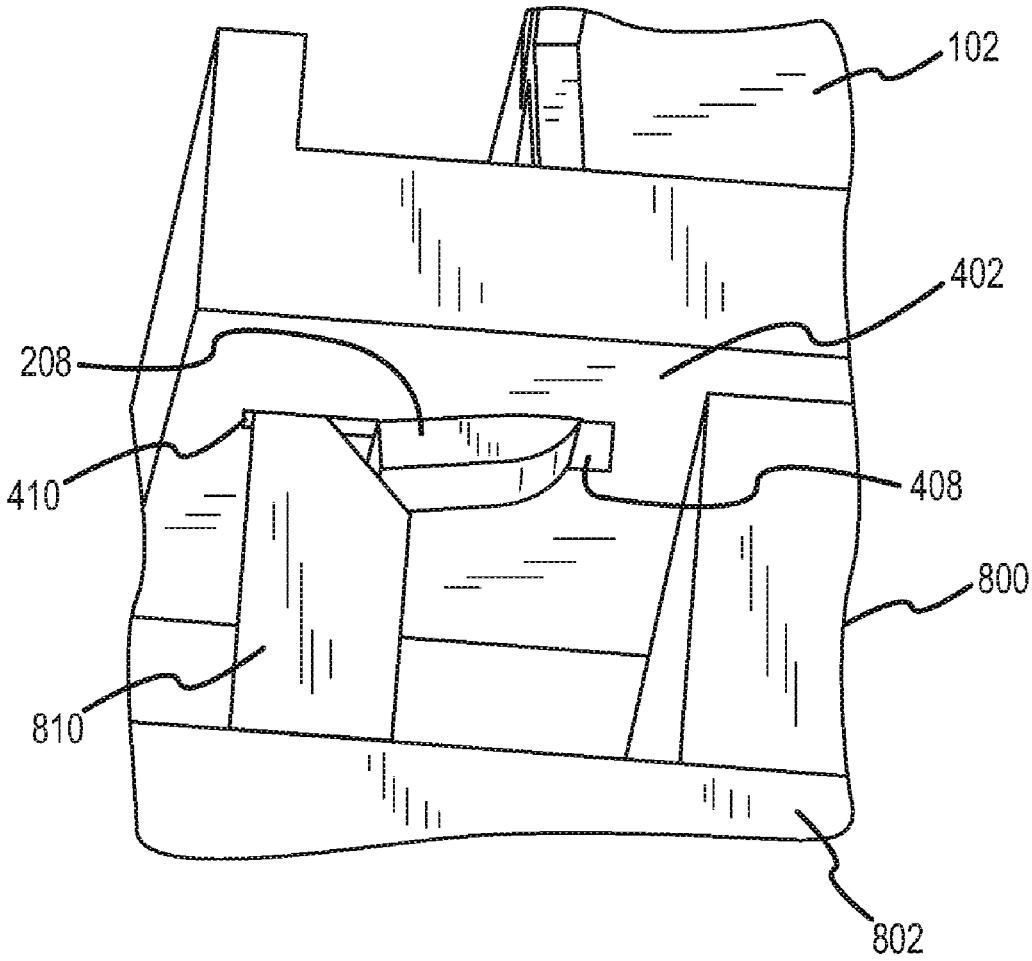
FIG. 10A is a close-up perspective view of the lower side of the assembly of FIG. 9A with a key of the socket partially engaged with a locking structure.
Figure 10B:
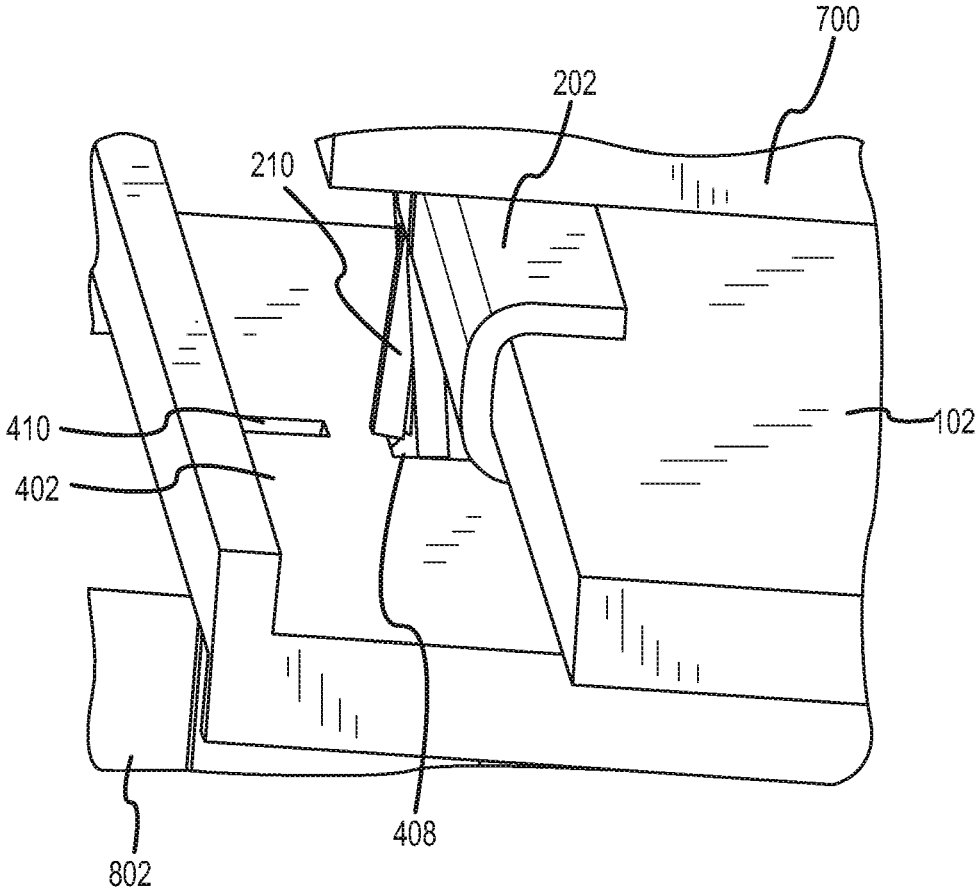
FIG. 10B is a close-up perspective view of an upper side of the assembly of FIG. 9A with a key of the socket partially engaged with a locking structure.

After the initial alignment of the assembly and the socket 800, as shown in FIGS. 9A and 9B, slight downward pressure may be placed on the assembly toward the socket 800. FIGS. 10A and 10B provide lower and upper respective views, respectively, of the interaction between the key 810 and the locking structure 206 as a result of such pressure. In FIG. 10A, the key 810, with its angled top surface, exerts pressure on the stop portion 208 of the locking structure 206 as the key 810 enters the alignment aperture 410, causing the locking structure 208 to bend toward the main portion of the socket 800 within the first aperture 408. As depicted in FIG. 10B, such pressure causes the lock portion 210 to begin moving over the first aperture 408. Thus, the locking portion 206 of the spring element 200 exhibits sufficient flexibility to bend in the intended direction as a result of the insertion of the key 810 into the alignment aperture 410.

Figure 11A:
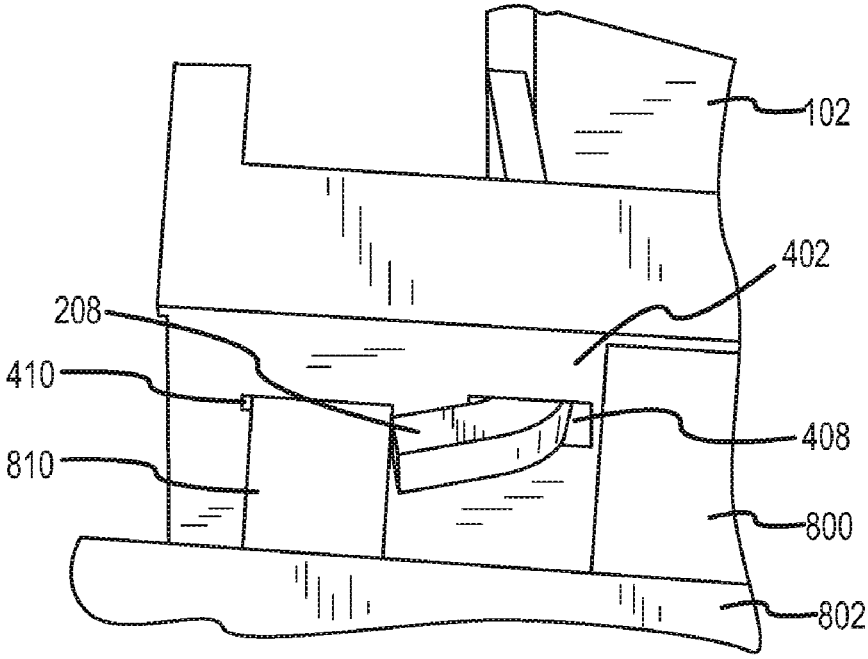
FIG. 11A is a close-up perspective view of the lower side of the assembly of FIG. 9A with a key of the socket fully engaged with a locking structure.
Figure 11B:
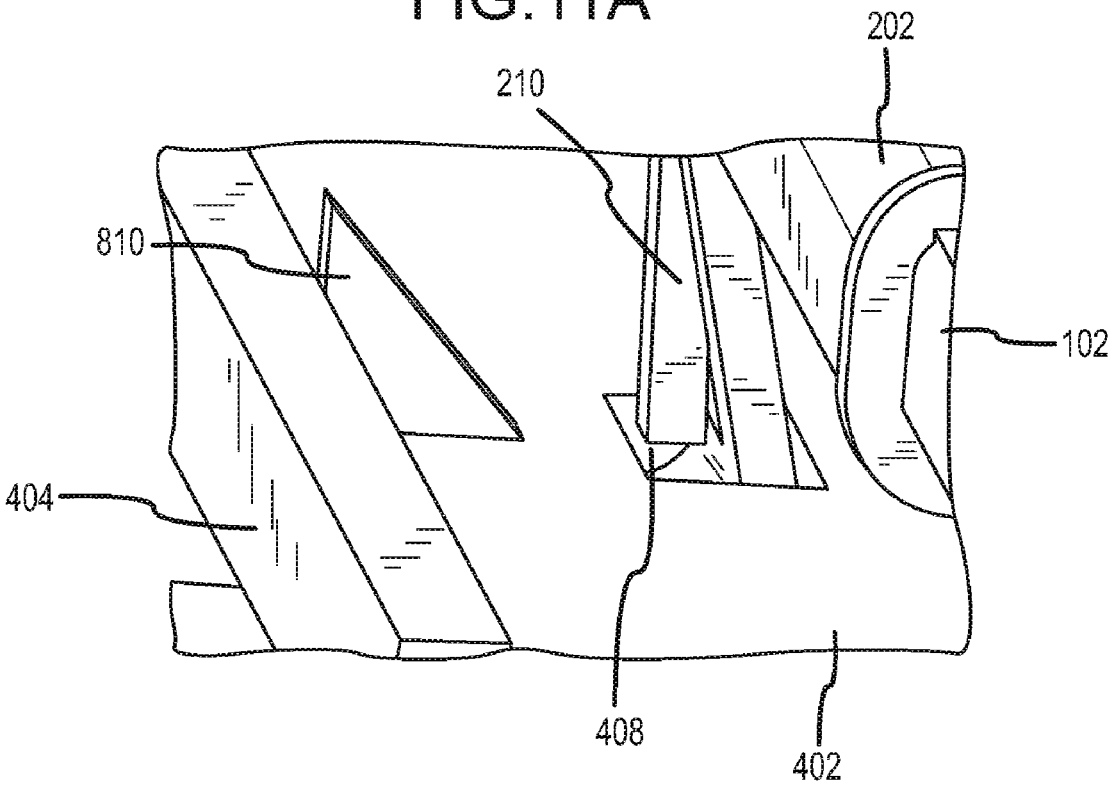
FIG. 11B is a close-up perspective view of the upper side of the assembly of FIG. 9A with a key of the socket fully engaged with a locking structure.
Figure 11C:
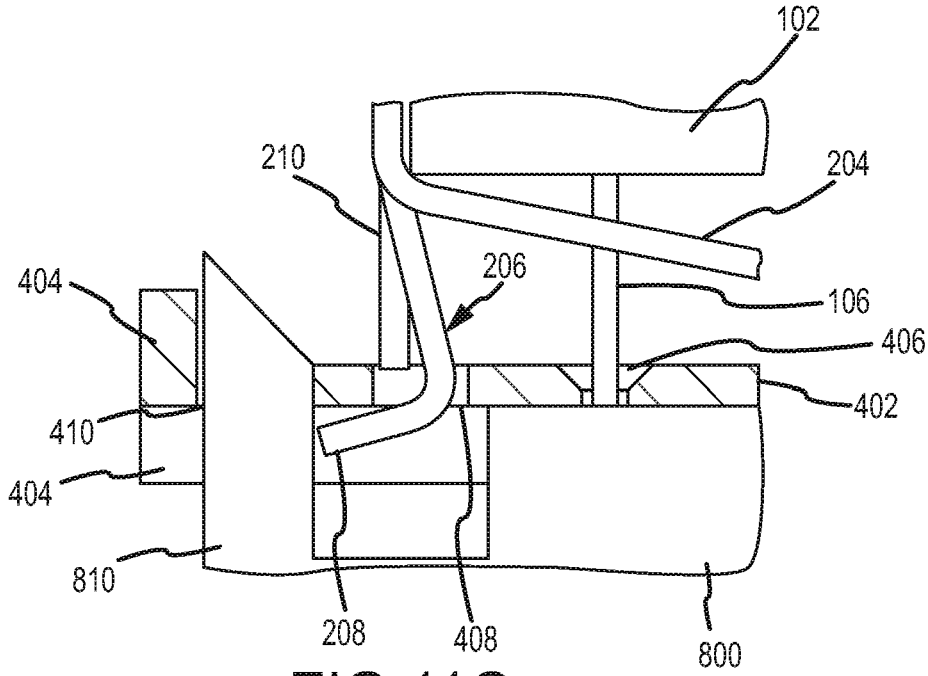
FIG. 11C is a close-up side sectional view of the assembly of FIG. 9A with a key of the socket fully engaged with a locking structure.

FIGS. 11A-11C provide further views of the assembly as it is urged further downward toward the socket 800. As seen in FIGS. 11A-11C, the movement of the key 810 progresses to the point at which the stop portion 208 is deflected sufficiently to allow the lock portion 210 to be positioned completely over the first aperture 408. This positioning allows the pin protector 400 to be forced upward toward the lower side of the processor board 100 against the force exerted by the cantilever springs 204 to expose the pins 106. In one embodiment, the pin protector 400 is moved upward by the top surface of the socket 800 as downward force on the processor board 100 and the rest of the assembly continues to be applied. As depicted best in FIG. 11C, the key 810 is of sufficient length to deflect the locking portion 206 a maximum amount before the pin protector 400 contacts the top of the socket 800. At this point, the pin protector 400 remains in the extended position, but is not locked in that position.

Figure 12:
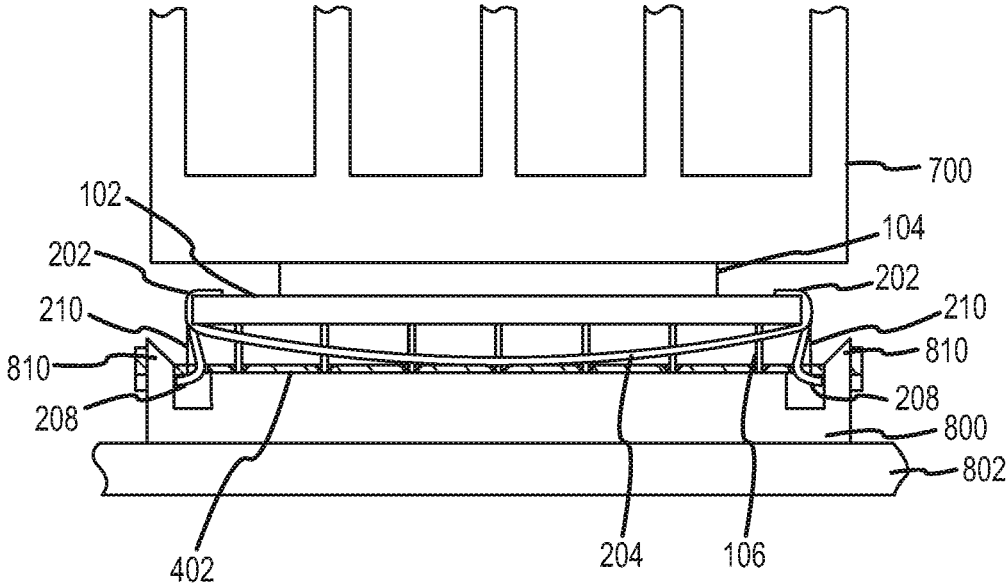
FIG. 12 is a side sectional view of the assembly of FIG. 9A with a key of the socket fully engaged with a locking structure and with the pin protector substantially extended.
Figure 13:
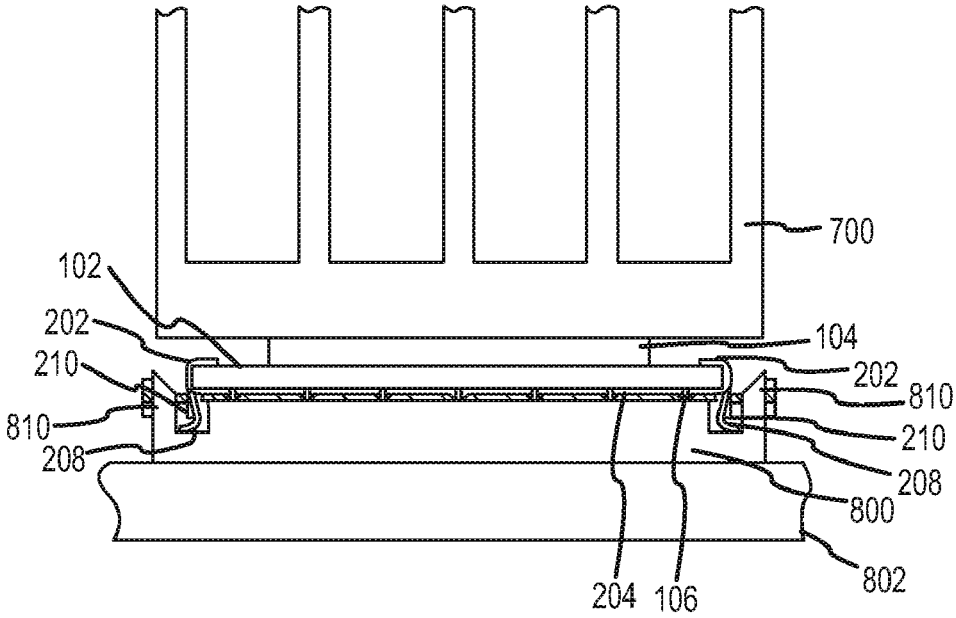
FIG. 13 is a side sectional view of the assembly of FIG. 9A with a key of the socket fully engaged with a locking structure and with the pin protector retracted so that the pins engage the socket.

A complete side view of the assembly of the processor board 100, the spring element 200, and the pin protector 400 at the extended, but unlocked, position described in FIGS. 11A-11C is presented in FIG. 12. As the assembly is further pressed downward toward the socket 800, the pins 106 enter the pin receiver holes 806 of the socket 800 (not explicitly shown in FIG. 12) as the pin protector 400 is pushed further upward by the top of the socket 800 toward the processor board 100. FIG. 13 provides a complete side view of the same assembly after the assembly has been fully pressed against the socket 800. More specifically, the top of the socket 800, the pin protector 400, and the bottom of the processor board 100 are all pressed together, resulting in the pin protector 400 assuming a fully-retracted position, thus allowing the pins 106 to fully engage with the socket 800. At that point, the cantilever springs 204 attain an essentially flat configuration.

At some later time, as the processor board 100 is removed from the socket 800, the process described above is essentially reversed. Specifically, as the processor board 100 is pulled upward, the cantilever springs 204 urge the pin protector 400 away from the lower surface of the processor board 100, and the key 810 of the socket 800 begins withdrawing from the alignment aperture 410 of the pin protector 400, all while the pin protector 400 remains in contact with the top of the socket 800. After the pin protector 400 has cleared the lock portion 210 of the locking structure 206, the key 810 begins allowing the locking structure 206 to return to its original position, as previously depicted in FIGS. 10A and 10B. As the pin protector 400 then approaches contact with the stop portion 208, the lock portion 210 of the locking structure 206 assumes its locking position, as shown previously in FIG. 5C. Accordingly, the pin protector 400 assumes its extended and locked position to protect the pins 106 as the removal of the assembly from the socket 800 is completed.

Various embodiments of the invention as discussed above may provide a permanently attached, lockable, and automatically retractable pin protector that operates upon normal insertion and removal of the pins of an electronic device into and out of an associated socket or comparable structure. As a result, the pins are protected from undesired forces at all times during which the pins are not inserted into the socket. Further, the use of a key and associated alignment aperture, as described herein, not only implement the locking feature described above, but also provide for proper alignment of the pins of the electronic device with the socket to prevent pin damage during the insertion phase.

While several embodiments of the invention have been discussed herein, other embodiments encompassed by the scope of the invention are possible. For example, while the embodiments disclosed above primarily address the connection of a processor board with a socket, other electronic devices and connection structures that utilize pins, such as ICs, multi-chip modules, PCBs, pin headers, and the like, may benefit from various implementations of the present invention. Further, aspects of various embodiments may be combined to create further implementations of the present invention. Thus, while the present invention has been described in the context of specific embodiments, such descriptions are provided for illustration and not limitation. Accordingly, the proper scope of the present invention is delimited only by the following claims and their equivalents.

What is claimed is:

1. An apparatus for protecting an array of pins of an electronic device, the apparatus comprising:

a pin protector defining an array of holes therethrough, wherein each hole is configured to receive one of the pins; and a spring element configured to bias the pin protector away from the electronic device toward an end of each of the pins, and to allow the pin protector to be retracted toward the electronic device to expose the pins for insertion into a socket, wherein the spring element comprises:

first and second hook structures configured to attach the spring element to opposing edges of the electronic device;

first and second cantilever springs configured to bias the pin protector away from the electronic device, wherein each end of the first cantilever spring is attached to a first end of each of the hook structures, and wherein each end of the second cantilever spring is attached to a second end of each of the hook structures.

2. The apparatus of claim 1, wherein at least one of the pin protector and the spring element is configured to engage with the socket to align the pins of the electronic device with the socket.

3. The apparatus of claim 1, wherein the spring element comprises a cantilever spring configured to bias the pin protector away from the electronic device.

4. The apparatus of claim 1, wherein the pin protector comprises a ribbed edge.

5. The apparatus of claim 1, wherein the holes of the pin protector are at least partially countersunk.

6. The apparatus of claim 1, wherein the pin protector comprises an alignment aperture configured to accept an alignment pin of the socket.

7. The apparatus of claim 1, wherein the pin protector comprises an electrically nonconductive material.

8. The apparatus of claim 1, wherein the spring element comprises at least one of spring steel, stainless steel, plastic, and foam.

9. The apparatus of claim 1, wherein the spring element is configured to allow a heat sink to be coupled with the electronic device.

10. The apparatus of claim 1, wherein the electronic device comprises a processor board.

11. The apparatus of claim 1, wherein the socket comprises a zero-insertion-force socket.

12. An apparatus for protecting an array of pins of an electronic device, the apparatus comprising:

a pin protector defining an array of holes therethrough, wherein each hole is configured to receive one of the pins; and a spring element configured to bias the pin protector away from the electronic device toward an end of each of the pins, and to allow the pin protector to be retracted toward the electronic device to expose the pins for insertion into a socket, wherein the spring element comprises:

a locking structure configured to maintain the pin protector at the end of each of the pins, wherein the locking structure comprises a stop portion and a lock portion, wherein the stop portion is configured to prevent the pin protector from being biased past the end of each of the pins, and wherein the lock portion is configured to prevent the pin protector from retracting toward the electronic device.

13. The apparatus of claim 12, wherein the pin protector defines a first aperture through which the locking structure extends.

14. The apparatus of claim 12, wherein the locking structure is configured to be deflected by a key of the socket to disengage the lock portion from the pin protector to allow the pin protector to be retracted.

15. The apparatus of claim 14, wherein the pin protector defines a second aperture through which the key extends.

16. An apparatus for protecting a plurality of pins extending from a side of an electronic device, the apparatus comprising:

a pin protector comprising a planar structure defining a plurality of holes, wherein each hole is configured to receive one of the pins; and a spring element comprising:

first and second hook structures, each of which is configured to attach to opposing edges of the electronic device;

first and second springs spanning between the first and second hook structures, wherein the springs are configured to be disposed along opposing sides of the plurality of pins, to bias the pin protector away from the electronic device toward an end of each of the pins, and to allow the pin protector to be retracted toward the electronic device to expose the pins for insertion into a socket;

a first locking structure extending from the first hook structure and a second locking structure extending from the second hook structure, the locking structures being configured to maintain the pin protector at the end of each of the pins when engaged with the pin protector, and to allow the pin protector to be retracted to expose the pins when disengaged from the pin protector.

17. The apparatus of claim 16, wherein the springs comprise cantilever springs.

18. The apparatus of claim 16, wherein each of the locking structures comprises a stop portion and a lock portion, wherein the stop portion is configured to prevent the pin protector from losing contact with the pins, and wherein the lock portion is configured to prevent the pin protector from moving toward the electronic device when the locking structure is engaged with the pin protector.

19. An apparatus for protecting an array of pins of an electronic device, the apparatus comprising:

a pin protector comprising a planar structure defining an array of holes, wherein each hole is configured to receive one of the pins; and means for biasing the pin protector away from the electronic device toward an end of each of the pins, wherein the biasing means allows the pin protector to be retracted toward the electronic device to expose the pins, wherein the means for comprises:

means for maintaining the pin protector at the end of each of the pins including means for preventing the pin protector from being biased past the end of each of the pins and means for preventing the pin protector from retracting toward the electronic device.

* * * * *

UNITED STATES PATENT AND TRADEMARK OFFICE

CERTIFICATE OF CORRECTION

PATENT NO. : 7,544,072 B2
APPLICATION NO. : 11/926274
DATED : June 9, 2009
INVENTOR(S) : Brandon Rubenstein et al.

It is certified that error appears in the above-identified patent and that said Letters Patent is hereby corrected as shown below:

In column 8, line 60, in Claim 19, after "for" insert -- biasing --.

Signed and Sealed this
Twenty-second Day of March, 2011

David J. Kappos

David J. Kappos
*Director of the United States Patent and Trademark Office*